US008172002B2

(12) United States Patent
Wrede et al.

(10) Patent No.: US 8,172,002 B2
(45) Date of Patent: May 8, 2012

(54) METHODS OF CONTROLLING HYDRAULIC MOTORS

(75) Inventors: Stefan Wrede, Kirchhundem (DE); Christof Kruse, Wenden (DE)

(73) Assignee: Longyear TM, Inc., South Jordan, UT (US)

( * ) Notice: Subject to any disclaimer, the term of this patent is extended or adjusted under 35 U.S.C. 154(b) by 0 days.

(21) Appl. No.: 13/295,349

(22) Filed: Nov. 14, 2011

(65) Prior Publication Data

US 2012/0055715 A1 Mar. 8, 2012

Related U.S. Application Data

(62) Division of application No. 12/412,156, filed on Mar. 26, 2009.

(51) Int. Cl.
*E21B 4/02* (2006.01)

(52) U.S. Cl. ..... 173/1; 173/148; 173/222; 137/596.18

(58) Field of Classification Search ..... 173/1, 148, 173/149, 157, 159, 218, 222, 8, 9, 11; 137/596.14, 137/595.15, 596.2, 596.1, 596.17, 596.18, 137/511; 175/24, 25
See application file for complete search history.

(56) References Cited

U.S. PATENT DOCUMENTS

| | | | |
|---|---|---|---|
| 2,904,287 | A | 10/1954 | Ertsgaard et al. |
| 3,160,033 | A | 12/1964 | Moyer |
| 3,212,589 | A | 10/1965 | Wink |
| 3,286,556 | A | 11/1966 | Reynolds et al. |
| 3,325,218 | A | 6/1967 | Kirkpatrick |
| 3,467,202 | A | 9/1969 | Brown |
| 3,528,510 | A | 9/1970 | Peterson |
| 3,802,057 | A | 4/1974 | Porter |
| 3,808,916 | A | 5/1974 | Porter et al. |
| 3,835,940 | A | 9/1974 | Winter, Jr. |
| 3,912,021 | A | 10/1975 | Cloup |

(Continued)

FOREIGN PATENT DOCUMENTS

DE 3315307 10/1984

(Continued)

OTHER PUBLICATIONS

International Search Report dated Nov. 30, 2010 as issued in connection with corresponding PCT Application No. PCT/US2010/028509, filed on Mar. 24, 2010.

(Continued)

*Primary Examiner* — Lindsay Low
*Assistant Examiner* — Andrew M Tecco
(74) *Attorney, Agent, or Firm* — Ballard Spahr LLP

(57) ABSTRACT

A hydraulic control system includes a first motor, a second motor, a pump operatively associated with the first motor, a first coupling valve operatively associated with the second motor, first parallel valves operatively associated with the second motor, and a first switching valve operatively associated with the first coupling valve and the first parallel valves. The first switching valve is configured to switch the first coupling valve between a first coupling state and a second coupling state opposite the first coupling state and to switch the first parallel valves between a first parallel state and a second parallel state opposite the first parallel state. While the first parallel valves are in the first parallel state a portion of the output of the first motor drives the second motor while the first parallel valves are in the second parallel state, the output of the pump drives the second motor.

17 Claims, 5 Drawing Sheets

U.S. PATENT DOCUMENTS

| | | | | |
|---|---|---|---|---|
| 3,967,534 | A | 7/1976 | Cryder et al. | |
| 3,979,944 | A * | 9/1976 | Salmi et al. | 173/8 |
| 4,570,706 | A | 2/1986 | Pugnet | |
| 4,609,053 | A | 9/1986 | Ragnmark | |
| 4,632,194 | A | 12/1986 | Averill | |
| 4,711,090 | A * | 12/1987 | Hartiala et al. | 60/422 |
| 5,516,268 | A | 5/1996 | Kassen et al. | |
| 5,561,645 | A | 10/1996 | Eastman et al. | |
| 5,803,189 | A | 9/1998 | Geldner | |
| 5,836,727 | A | 11/1998 | Scheer | |
| 5,954,346 | A | 9/1999 | McLaren | |
| 6,505,689 | B1 | 1/2003 | Poysti et al. | |
| 6,719,303 | B2 | 4/2004 | Stephens | |
| 2001/0003317 | A1 * | 6/2001 | Klemm | 173/222 |
| 2002/0197174 | A1 | 12/2002 | Howard | |
| 2009/0025947 | A1 * | 1/2009 | Peltonen | 173/8 |

FOREIGN PATENT DOCUMENTS

| | | |
|---|---|---|
| DE | 3411889 | 9/1985 |
| DE | 3723819 | 1/1989 |
| DE | 3802443 | 3/1989 |
| DE | 3904631 | 8/1990 |
| DE | 3922776 | 1/1991 |
| DE | 19512109 | 10/1996 |
| DE | 10134000 | 1/2003 |
| DE | 20200401525 | 6/2005 |
| DE | 202005008630 | 10/2005 |
| DE | 202007001858 | 5/2007 |
| ES | 2051613 | 6/1994 |
| ES | 1632637 | 3/2006 |
| GB | 337834 | 11/1930 |
| GB | 1603608 | 11/1981 |
| GB | 2273120 | 6/1994 |

OTHER PUBLICATIONS

Hsai-Yang Fang, Foundation Engineering Handbook, Published 1991, Springer, 924 pages. Discussion: p. 24, section 1.8.10 discusses rotary drilling, drill rods, drill heads, rotary drive mechanisms, and hollow spindles.

Simco Drilling Equipment, Inc., 2800 HS(HT) Wet Rotary Drill, Excerpt: "Hydraulic Drive, Hollow Spindle Drill Head"—Single speed torque range (2840 ft. lbs. max/0-185 RPM0. Has a 2" ID hollow spindle. [online] [retrieved on Oct. 8, 2008], 3 pgs. Retrieved from the Internet: http://www.simcodrill.com/2800wet.html.

Novamac Eurasia, Excerpt:Drill Head: Novamac 6000; Two speeds hollow spindle rotary drive, variable/reversible hydraulic motor; 1st gear: Max torque 7500 LBF-ft (10170Nm) at 5000psig (345bar) max speed 250rpm; 2nd gear: Max torque 1300 LBF-ft (1763 Nm) at 5000psig (345bar) max speed 1500rpm; Floating spindle for RC and DTH drilling. [online] [retrieved on Oct. 8, 2008], 3 pgs. Retrieved from the Internet:http://novamac-eurasia.ecocity-group.com/ET642-RC.html.

Hydraulic Drilling & Investigation Rigs. Excerpt: "Beretta T21; The Rotary drill head has a modular structure and by superimposing 1-2 or 3 hydraulic motors, it is possible to select various rpm and torque." [online] [retrieved on Oct. 8, 2008], 1 pg. Retrieved from the Internet http://www.airfluidotago.com/beretta.html.

USPTO, Notice of Allowance from U.S. Appl. No. 12/412,156, mailed Oct. 20, 2011, 16 pages.

* cited by examiner

METHODS OF CONTROLLING HYDRAULIC MOTORS

CROSS-REFERENCE TO RELATED APPLICATIONS

This patent application is a divisional application of prior U.S. patent application Ser. No. 12/412,156, filed on Mar. 26, 2009, entitled "HYDRAULIC CONTROL SYSTEM FOR DRILLING SYSTEMS." The contents of the foregoing patent application are hereby incorporated by reference in their entirety.

BACKGROUND OF THE INVENTION

1. The Field of the Invention

The present invention relates to hydraulic control systems for drilling systems and to hydraulic control systems for drill heads in particular.

2. The Relevant Technology

Drilling rigs are often used for drilling holes into various substrates. Such drill rigs often include a drill head mounted to a mast. The rig often includes mechanisms and devices that are capable of moving the drill head along at least a portion of the mast. The drill head often further includes mechanisms that receive and engage the upper end of a drill rod or pipe. The drill rod or pipe may be a single rod or pipe or may be part of a drill string that includes a cutting bit or other device on the opposing end, which may be referred to as a bit end.

The drill head applies a force to the drill rod or pipe which is transmitted to the drill string. If the applied force is a rotational force, the drill head may thereby cause the drill string to rotate within the bore hole. The rotation of the drill string may include the corresponding rotation of the cutting bit, which in turn may result in cutting action by the drill bit. The forces applied by the drill head may also include an axial force, which may be transmitted to the drill string to facilitate penetration into the formation.

In many instances, specialized drill heads are utilized for differing applications. For example, drill heads include drill heads that are selected to suit given drilling conditions. As a result when conditions change, a different drill head if not an entirely different drill rig is used, thereby increasing capital costs and/or down time.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF THE INVENTION

A hydraulic control system includes a first motor, a second motor, a pump operatively associated with the first motor, a first coupling valve operatively associated with the second motor, first parallel valves operatively associated with the second motor, and a first switching valve operatively associated with the first coupling valve and the first parallel valves. The first switching valve is configured to switch the first coupling valve between a first coupling state and a second coupling state opposite the first coupling state and to switch the first parallel valves between a first parallel state and a second parallel state opposite the first parallel state. While the first parallel valves are in the first parallel state a portion of the output of the first motor drives the second motor while the first parallel valves are in the second parallel state, the output of the pump drives the second motor.

A drill head assembly includes a modular base assembly, a plurality of motor assemblies including at least a first motor and a second motor, the motor assemblies being configured to be interchangeably coupled to the modular base assembly, and a hydraulic control system configured to drive the first motor and the second motor including a pump operatively associated with the first motor, a first coupling valve operatively associated with the second motor, first parallel valves operatively associated with the second motor, and a first switching valve operatively associated with the first coupling valve and the first parallel valves. The first switching valve is configured to switch the first coupling valve between a first coupling state and a second coupling state opposite the first coupling state and to switch the first parallel valves between a first parallel state and a second parallel state opposite the first parallel state. While the first parallel valves are in the first parallel state a portion of the output of the first motor drives the second motor and while the first parallel valves are in the second parallel state a portion of the output of the pump drives the second motor.

A method of drilling includes driving a first motor with a pump, selectively driving a second motor in series operation by blocking at least a portion of the output of the first motor from passing through first parallel valves while directing at least a portion of the output of the pump through a first coupling valve to opposing inlets of the second motor such that a portion of the output of the first motor drives the second motor, and selectively driving at least one motor in parallel operation by directing at least a portion of the output of the pump through the parallel valves while blocking at least a portion of the output of the pump through the first coupling cartridge.

This Summary is provided to introduce a switching of concepts in a simplified form that are further described below in the Detailed Description. This Summary is not intended to identify key features or essential characteristics of the claimed subject matter, nor is it intended to be used as an aid in determining the scope of the claimed subject matter.

BRIEF DESCRIPTION OF THE DRAWINGS

To further clarify the above a more particular description of the disclosure will be rendered by reference to specific examples that are illustrated in the appended drawings. It is appreciated that these drawings depict only typical examples and are therefore not to be considered limiting. The examples will be described and explained with additional specificity and detail through the use of the accompanying drawings in which.

Figure 1:
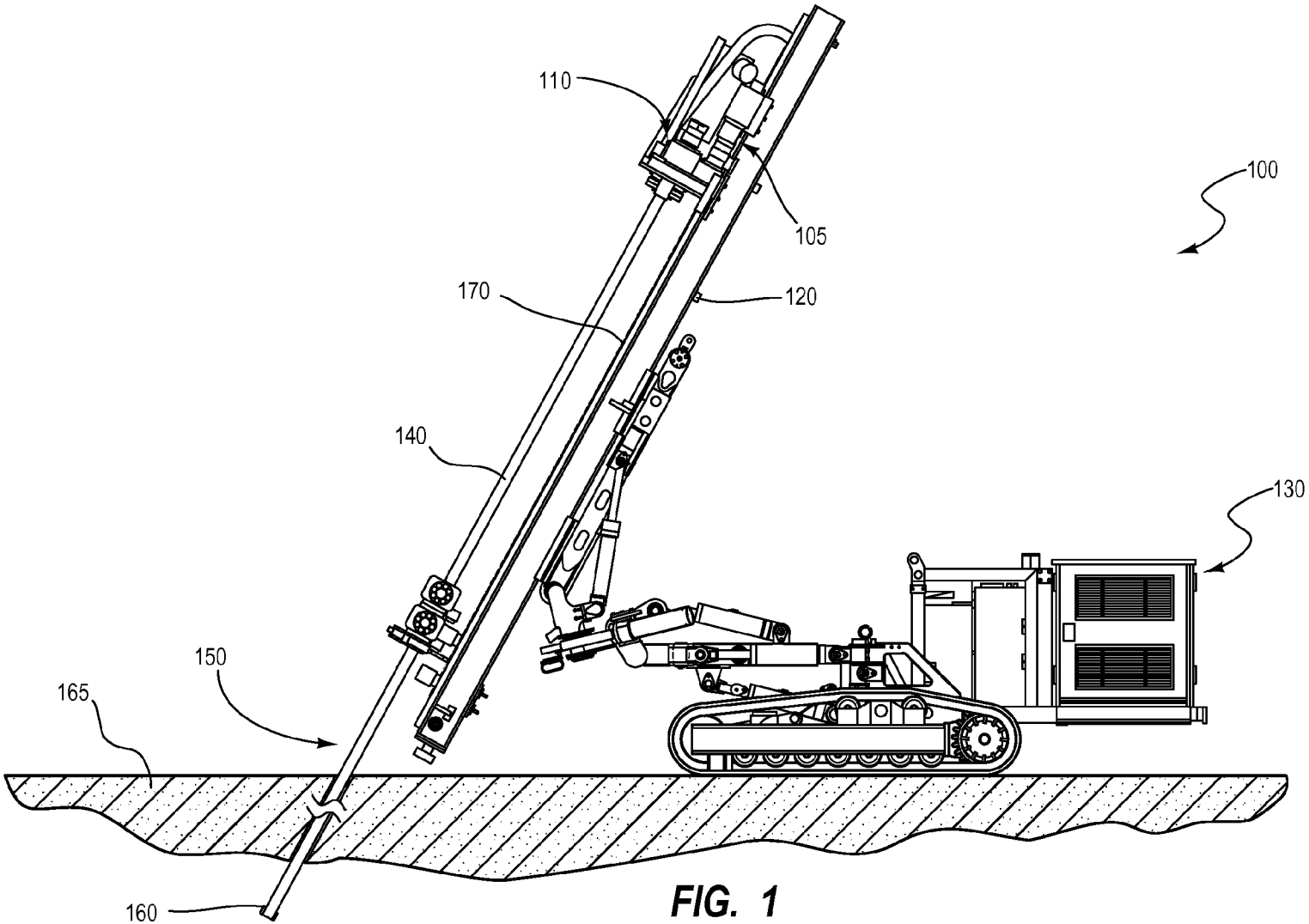
FIG. 1 illustrates a drilling system according to one example.

Together with the following description, the figures demonstrate non-limiting features of exemplary devices and methods. The thickness and configuration of components can be exaggerated in the figures for clarity. The same reference numerals in different drawings represent similar, though not necessarily identical, elements.

DETAILED DESCRIPTION OF THE PREFERRED EMBODIMENTS

A control system is provided herein that is configured to control a variety of motors, such as drilling motors, in parallel as well as in series. Such control can include controlling or driving valve in star (VIS) type motors in series as well as in parallel. Such a configuration can provide relatively high power and efficiency. This efficiency can in turn reduce heat buildup and problems associated with that buildup. For ease of reference, hydraulic control systems will be described, though it will be appreciated that the control system can be applied to other types of control systems. As discussed below, the hydraulic control system can allow for the use of motors with different hydraulic displacements without the use of mechanical clutches. Further, the flexibility of the hydraulic control system can provide for more gear combinations than other systems. While any motive power can be used, for ease of reference the control system will be discussed with hydraulic power as the motive power source.

FIG. 1 illustrates a drilling system 100 that includes a sled assembly 105 and a drill head 110. The sled assembly 105 can be coupled to a mast 120 that in turn is coupled to a drill rig 130. The drill head 110 is configured to have one or more threaded member(s) 140 coupled thereto. Threaded members can include, without limitation, drill rods and rod casings. For ease of reference, the tubular threaded member 140 will be described as a drill rod. The drill rod 140 can in turn be coupled to additional drill rods to form a drill string 150. In turn, the drill string 150 can be coupled to a drill bit 160 or other down-hole tool configured to interface with the material to be drilled, such as a formation 165.

In at least one example, the drill head 110 illustrated in FIG. 1 is configured to rotate the drill string 150 during a drilling process. In particular, the drill head 110 may vary the speed at which the drill head 110 rotates as well as the direction. In particular, the rotational rate of the drill head and/or the torque the drill head 110 transmits to the drill string 150 may be selected as desired according to the drilling process. For example, the motors, pinions, and/or gear wheels may be interchanged to provide the rotational rate and/or torque desired to suit different drilling applications.

Further, the sled assembly 105 can be configured to translate relative to the mast 120 to apply an axial force to the drill head 110 to urge the drill bit 160 into the formation 165 during a drilling operation. In the illustrated example, the drilling system 100 includes a drive assembly 170 that is configured to move the sled assembly 105 relative to the mast 120 to apply the axial force to the drill bit 160 as described above. As will be discussed in more detail below, the drill head 110 can be configured in a number of ways to suit various drilling conditions.

Figure 2:
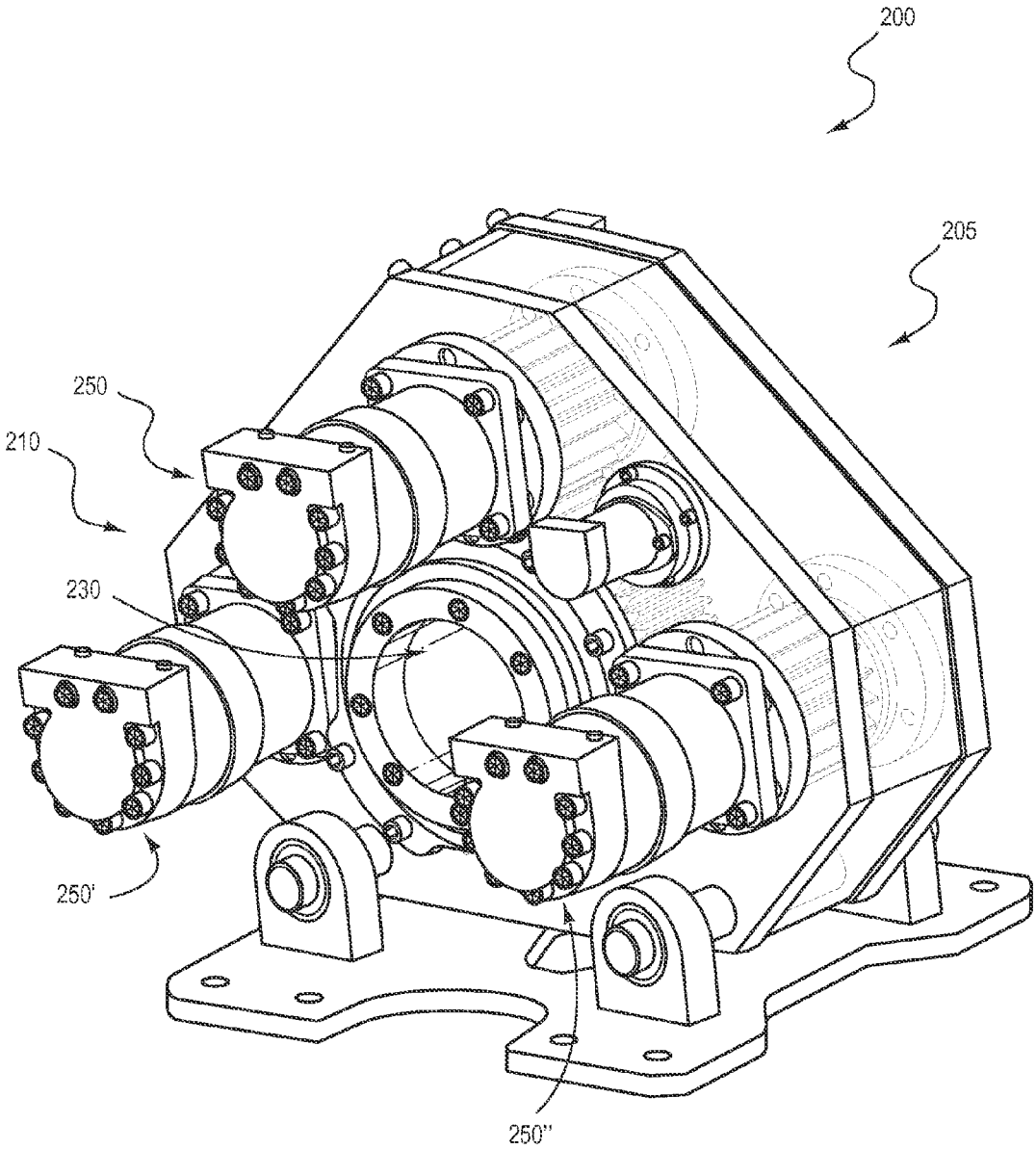
FIG. 2 illustrates a rotary head according to one example.

In at least one example, the drilling system 100 includes a hydraulic control system (not shown) configured to control the operation of the drill head 110. In particular, as illustrated in FIG. 2, a rotary drill 200 can include a modular base assembly 205. The modular base assembly 205 includes a gear housing 210 that supports a drive flange assembly 230. The gear housing 210 is configured to provide a base to which one or more motor assemblies, such as motor assemblies 250, 250', and 250", can be interchangeably coupled. The motor assemblies 250, 250', and 250" (not shown) are operatively associated with the drive flange assembly 230 to provide motive force to rotate a drill rod or other components. The hydraulic control system is configured to control the operation of a variety of motor types, including motors that are similar as well as motors that are different. In particular, the hydraulic control system can be configured to selectively drive the motors in parallel or series. Further, the hydraulic control system can allow for the use of motors having different displacements. In at least one example the motor assemblies 250, 250', 250" can be valve-in-star (VIS) type motors that are driven by the hydraulic control system in series. One exemplary drill head is described in more detail in currently co-pending patent application Ser. No. 12/239,468 filed Sep. 26, 2008 and entitled "Modular Rotary Drill Head," the disclosure of which is incorporated by reference in its entirety. While the hydraulic control system described below can be used to drive the drill head in the referenced patent application, it will be appreciated that the hydraulic control system can be used to control any system using one or more motors.

Figure 3A:
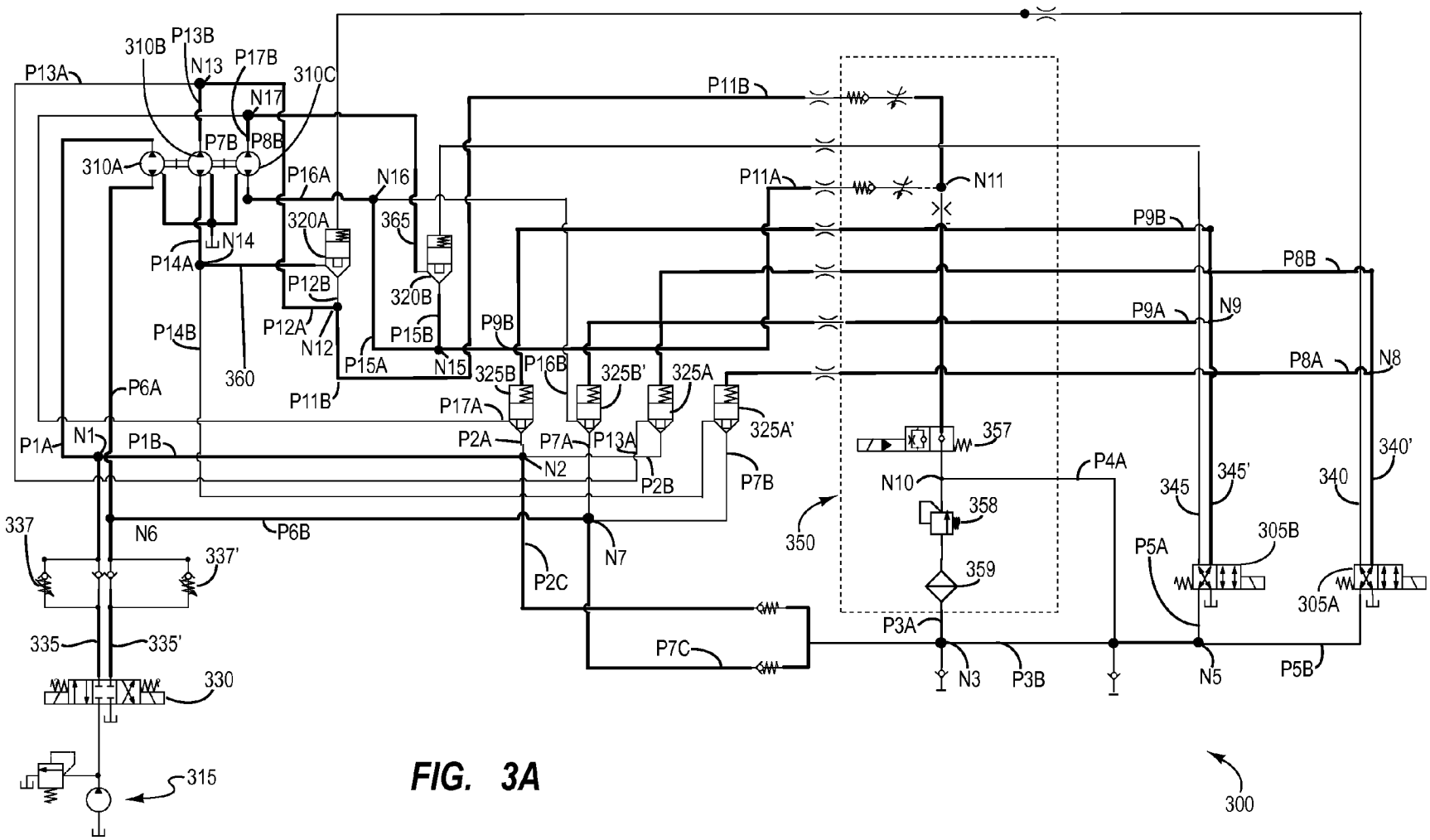
FIGS. 3A-3B are schematic diagrams of a control system according to one example.
Figure 3B:
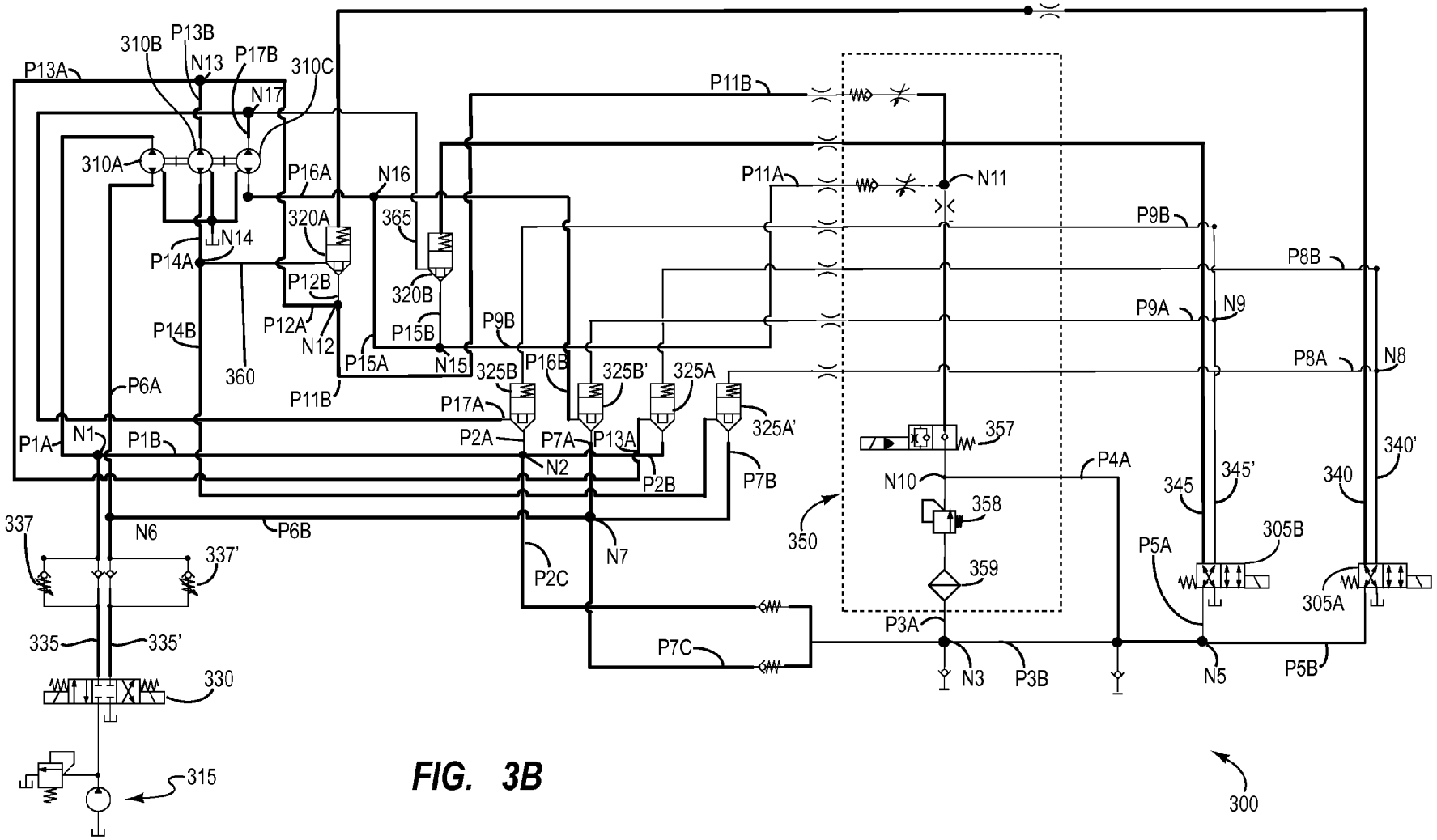

FIGS. 3A-3B are hydraulic circuit diagrams of a hydraulic control system 300 according to one example. In the illustrated example, the hydraulic control system 300 can be secured to or integrated with a valve block. While the components described below can be positioned within a valve block, it will be appreciated that the components can also be positioned and arranged in any desired manner.

The hydraulic control system 300 includes a first switching valve 305A, a first motor 310A and at least a second motor 310B. A pump 315 provides motive power for the first and second motors 310A, 310B. The first switching valve 305A cooperates with a first coupling valve 320A and first parallel valves 325A, 325A' to switch the second motor 310B between series and parallel operation with the first motor 310A and/or a third motor 310C. Similarly, a second switching valve 305B can cooperate with a second coupling valve 320B and second parallel valves 325B, 325B' to switch the third motor 310C between series and parallel operation. The hydraulic control system 300 can further include any number of additional motors having associated switching valves, coupling valves, and parallel valves.

In the illustrated example, the pump 315 provides motive power to each of the motors. While a three motor system is illustrated, it will be appreciated that fewer or more than three motors can be used by employing additional coupling valves with associated parallel valves. Series operation will first be described, followed by a discussion of parallel operation.

FIG. 3A illustrates the hydraulic control system 300 in series operation. In the illustrated example, fluid pathways that are at relatively higher pressures or flows are shown with heavier lines while fluid pathways at relatively lower pressures or flows are depicted with lighter lines. In at least one example, while the first coupling cartridge 320A is in one state, either open or closed, the associated first parallel valves 325A, 325A' are in the opposite state. Similarly, while the second coupling cartridge 320B is in one state the associated second parallel valves 325B, 325B' are in the opposite state.

In both series and parallel operation, the pump 315 is coupled to a valve, such as a spool valve 330. The spool valve 330 in turn is coupled to pathways 335, 335'. Optional backflow valves 337, 337' maintain back flow as appropriate to the first motor 310A. In at least one example, the valves 337, 337' maintain an appropriate backpressure, such as a backpressure of about 3 bar, to reduce or eliminate cavitations in the control system 300.

In both series and parallel, the pump 315 provides fluid to the first motor 310A as well as the first and second switching valves 305A, 305B through pathways 335, 335'. Controlling the flow through pathways 335, 335' allows the hydraulic control system 300 to cause the first motor 310A to rotate in opposite directions while providing motive power for the operation of the first and second switching valves 305A, 305B to switch the hydraulic control system 300 between series and parallel. Operation of the first motor 310A will first be introduced, followed by a discussion of the first and second switching valves 305A, 305B.

With respect to the first motor 310A, greater flow through pathway 335 will cause the first motor 310A to rotate in one direction while greater flow through 335' will cause the first motor 310A to rotate in the opposite direction. In particular, pathway 335 is in communication with node N1. Node N1 is in communication with pathways P1A and P1B. Pathway P1A is in communication with an inlet of the first motor 310A. Similarly, pathway 335' is in communication with node N6. Node N6A is in communication with pathways P6A and P6B. P6B is in communication with the opposing outlet of the first motor 310A. Accordingly, the spool valve 330 is configured to direct fluid to opposing inlets of the first motor 310A to thereby drive the first motor 310A.

A portion of the flow through pathways 335, 335' can also be used to switch the hydraulic control system 300 between series and parallel operation. In particular, pathway 335 is in communication with pathway P1B via node N1. Pathway P1B is in communication with node N2. Node N2 is in further communication with pathways P2A, P2B, and P2C. Pathways P2A and P2B are in communication with the parallel cartridges 325A, 325B. How fluid is routed by the parallel cartridges 325A, 325B depends on whether the parallel cartridges 325A, 325B are open or closed, each of will be discussed in more detail below.

Pathway P2C is in communication with node N3. Node N3 is in communication with pathways P3A and P3B. Pathway P3A inlets to the internal flushing system 350. Node N4 illustrates an inlet configured to allow an external flushing system (shown in FIG. 4) to be coupled to the hydraulic control system.

Pathway P3B is in communication with node N5. Node N5 in turn is in communication with the first switching valve 305A by way of pathway P5B and the second switching valve by way of pathway P5A. Accordingly, a fluid pathway can be established between the pump 315 and the first and second parallel valves 305A, 305B through pathway 335.

A portion of the fluid that is directed through pathway 335' is also directed to the first and second switching valves 305A, 305B. In particular, fluid flowing through pathway 335' is directed to pathway P6B via node N6. Pathway P6B is in communication with node N7. Node N7 is in further communication with pathways P7A, P7B, and P7C. Flow of fluid relative to pathways P7A and P7B will be discussed in more detail in conjunction with the operation of the parallel valves 325A', 325B'.

Pathway P7C is communication with node N3, which in turn is in communication with first and second switching valves 305A, 305B by way of pathways P3B and node N5 as previously discussed. Accordingly, a portion of the output of the pump 315 is directed to the first and second switching valves 305A, 305B. As illustrated in FIG. 3A, pathways P2C and P7C direct a portion of the output of the pump 315 to node N3. This fluid pathway can provide the motive power for the parallel valves 305A, 305B to switch the second and third drive motor 310B, 310C between series and parallel operation. The switching valves 305A, 305B can be separately operated to independently switch the second motor 310B and the third drive motor 310C between series and parallel operation.

To switch the second drive motor 310B between series and parallel operation, the first switching valve 305A opens and closes the first coupling cartridge 320A and the first parallel valves 325A, 325A' by way of pathways 345, 345'. In at least one example, first parallel valves 325A, 325A' can each include a biasing member that biases the first parallel valves 325A, 325A' into one position, such as the open position. Similarly, the first coupling valve 320A can also include a biasing member that biases the first coupling valve 320A in the same position as the same position as the first parallel valves 325A, 325A', such as the open position.

The first switching valve 305 can provide opposing inputs to the first coupling valve 320A and the first parallel valves 325A, 325A'. Such a configuration can allow a single switching valve to place the first coupling valve 320A and the first parallel valves 325A, 325A' in opposing states. It will be appreciated that the states can be reversed and the output of the switching valve also switched to provide the same operation.

To operate the second motor 310B in series, the first switching valve 305A can be switched such that the first switching valve 305A directs flow through pathway 340 to maintain the first coupling valve 320A in an open position. This flow can be a portion of the output of the pump 315 as previously discussed. Further, while the first switching valve 305A is switched to series mode, the first switching valve 305A also directs fluid through pathway 340' to maintain the first parallel valves 325A, 325A' in a closed position.

In particular, pathway 340' is in communication with node N8. Node N8 is in further communication with pathways P8A and P8B, which are in communication with first parallel cartridges 325A', 325A respectively. In series mode, the press in pathway 340' can be high relative to the pressure in pathway 340 such that the first coupling cartridge 320A open and the first parallel valves 325A, 325A' are closed.

The second switching switch 305B can be operated to switch the third motor 310C between series and parallel operation independently of the second motor 310B. In series mode, the second switching valve 305B directs flow through pathway 345 to maintain the second coupling valve 320B in an open position.

While the first switching valve 305A is switched to series mode, the second switching valve 305B maintains the second parallel valves 325B, 325B' in a closed position by way of pathway 345'. In particular, pathway 345' is in communication with node N9. Node N9 is in further communication with pathways P9A and P9B, which are in communication with second parallel cartridges 325B', 325B respectively.

Accordingly, the second switching switch 305B can be configured to open and close the second coupling cartridges 320B and the second parallel valves 325B, 325B' to switch the third motor 310C between series and parallel operation. Operation will now be described in which the second motor 310B and the third motor 310C are both operated in series followed by a discussion the second motor 310B and the third motor 310C are both operated in parallel. As previously introduced, in both series and parallel operation the pump 315 routes fluid through pathways 335, 335'. In series operation, fluid incident on node N1 is directed through node N1 to an inlet of the first motor 310A and node N2.

As previously discussed, node N2 is in further communication with pathways P2A, P2B, and P2C. Pathway P2A is in communication with second parallel valve 325B while pathway P2B is in communication with first parallel valve 325A. In series operation, both the first parallel valve 325A and the second parallel valve 325B are closed. As a result, fluid incident on node N2 is routed through pathway P2C.

Similarly, fluid routed through pathway 335' to node N6 is directed to an opposing inlet of the first motor 310A and to node N7. Node N7 is in further communication with the second parallel valve 325B' by way of pathway P7A and first parallel valve 325A' by way of pathway P7B. In series operation, the first parallel valve 325A' and the second parallel valve 325B' are closed such that flow incident on node N7 is directed through pathway P7C.

Pathways P2C and P7C are in communication with node N3. In at least one example, check valves can be positioned in one or both of the pathways P2C and P7C to allow fluid to flow from pathways P2C and P7C to node N3 while checking the flow of fluid in the reverse direction. Fluid from node N3 is then directed to either the internal flushing system 350 via pathway P3A or toward the first and second switching valves as discussed above.

In the illustrated example, the flushing system 350 includes a fluid conditioner 359, such as a filter configured to filter particulates greater than about 5-10 μm from the fluid. The fluid conditioner 359 is in communication with a pressure limiting valve 358. The pressure limiting valve 358 can be configured to provide a selected pressure setting for the internal flushing system 350 independently from the inlet pressure provided by pathways P2C and P7C. Such a configuration can help ensure the pressure levels of the fluid directed from the internal flushing system 350 to the motors 310A, 310B, and/or 310C remain below a desired level, such as below the value established by the pressure limiting valve 358.

The pressure limiting valve 358 is in communication with node N10. Node N10 is in further communication with a flow regulating valve 357. Pathway P4A is in communication with pathway P3B, and thus in communication with the first and second switching valves 305A, 305B as described above. The flow regulating valve 357 provides an appropriate oil flow for the internal flushing system 350 according to the chosen motor size and/or type and if the motors are in full or half displacement two-speed mode which may be a proportional or a fix adjusted on-off valve type. Accordingly, in series operation, fluid from the internal flushing system 350 is directed through 366 to node N17 and via pathways 367 and 367' to node N6 and node N9. Node N6 is in communication with parallel cartridge 320A and Node N9 is in communication with parallel cartridge 320B. The flow from the lubrication system fills then up leak oil from the motors when they are operated in series operation mode. This prevents damages due cavitations.

Fluid directed from the internal flushing system 350 is incident on node N11. Node N11 is in further communication with pathways P11A and P11B. Pathway P11A is incident on node N12. Node N12 is in further communication with pathway P12A and pathway P12B, which is in communication with the first coupling cartridge 320A. In series operation the first coupling cartridge 320A is open. Accordingly, fluid flows through pathway P12A to node N13. Node 13 is in further communication with pathway P13B and pathway P13A. Pathway P13A is in communication with an inlet of the second motor 310B while pathway P13A is in communication with the first coupling cartridge 325A, which is closed in series operation. Accordingly, a portion of the flow incident on node N12 is routed to an inlet of the second motor 310B.

Another portion of the flow incident on node N12 is routed to an opposing inlet of the second motor 310B. In particular, as introduced the first coupling valve 320A is open in series operation. Accordingly, fluid directed to pathway P12B passes through the first coupling valve 320A to outlet 360. Outlet 360 is in communication with node N14. Node N14 is in further communication with pathways P14A and P14B. Pathway P14A is in communication with the opposing inlet of the second motor 310B while pathway P14B is in communication with first parallel cartridge 325A', which is closed in series operation. Accordingly, fluid from the internal flushing system 350 is directed to opposing inlets of the second motor 310B during series operation.

In series operation, the second motor 310B is coupled to an output of the first motor 310A in such a manner that motive power for driving the second motor 310B is received from the first motor 310A. The coupling can be mechanical, such as by a shaft and/or hydraulic or any other type of coupling.

This configuration allows a portion of the motive power that drives the first motor 310A to also drive the second motor 310B and/or the third motor 310C in series. In particular, the pump 315 is coupled to a valve, such as the spool valve 330. The spool valve 330 in turn is coupled to pathways 335, 335'.

Accordingly, a portion of the motive power directed to the first motor 310A is used to drive the second motor 310B. As described above, the first coupling cartridge 320A is configured to deliver equal flow to each of the inlet of the second motor 310B. Equal flow to each of the ports may cause the flow from one port to balance the force from the other port resulting in no net force due to flow from the first coupling cartridge 320A. Such a configuration in turn may allow the second motor 310B to rotate freely and without back pressure. In addition, the flow of fluid from the internal flushing system 350 can allow differently sized motors to be driven in series. In particular, the volume within the second motor 310B can be maintained as desired through the flow of fluid from the first coupling cartridge 320A as provided by the internal flushing system 350.

As previously discussed, additional motors can also be coupled to the hydraulic control system and driven in series or parallel. For example, an output of the second motor 310B can be coupled to the third motor 310C. As introduced, the internal flushing system 350 directs a balanced flow to opposing inlets of the second motor 310B through node N11 via pathway P11B. The internal flushing system 350 also directs a balanced flow to opposing inlets of the third motor 310C through node N11 via pathway P11A.

Pathway P11A is in communication with node N15, which is in further communication with pathways P15A and P15B. Pathway P15A is in communication with node N16, which is in further communication with pathways P16A and P16B. Pathway P16B is in communication with second parallel cartridge 325B', which is closed in series operation.

Accordingly, fluid incident on node N6 is routed to pathway P16A, which is in communication with an inlet of the third motor 310C. The opposing inlet of the third motor 310C receives a balanced flow via node N15 as well. In particular, node N15 is in communication with the second coupling cartridge 320B by way of pathway P15B. When open the second coupling cartridge 320B receives the flow from pathway P15B and directs it to an outlet 365, which is in communication with node N17. Node N17 in turn in communication with pathways P17A and P17B. Pathway P17A is in communication with coupling cartridge 325B, which is closed in series operation. Accordingly, fluid incident on node N17 is directed to pathway P17B, which in communication with an opposing inlet of the third motor 310C to balance the flow of fluid received by the other inlet 310C.

As a result, the third motor 310C can operate efficiently using the output of the second motor 310B as the third motor 310C is able to rotate freely and without backpressure. In addition, the flow of fluid from the internal flushing system 350 through the second coupling cartridge 320B can allow differently sized motors to be driven in series as described above.

In addition to providing series operation for the motors 310A, 310B, 310C, the hydraulic control system 300 allows for parallel operation, as illustrated in FIG. 3B. In parallel operation, the first coupling cartridge 320A and the second coupling cartridge 320B are closed while the associated parallel valves 325A, 325A', 325B, 325B' are open. In at least one example, the first coupling cartridge 320A can be closed and the first parallel valves opened 325A, 325A' by the first switching valve 305A by way of pathways 340, 340' respectively. Similarly, the second coupling cartridge 320B can be closed and the second parallel valves opened 325B, 325B' by the second switching valve 305B by way of pathways 345, 345' respectively.

Accordingly, fluid from the pump 315 can be directed from pathway 335 to pathway P1B. Pathway P1B is in communication with node N2. As introduced, a portion of the flow incident on node N2 is directed to the internal flushing system 350 and the first and second switching valves 305A, 305B via pathway P2C. In parallel operation, a portion of the flow incident on node N2 is directed to opened parallel valves 325B, 325A by way of pathways P2A and P2B respectively.

Flow directed to the parallel valve 325B is directed to node N17 via pathway N17A. Node N17A is in further communication with pathway 365 associated with the second coupling cartridge 320B, which is closed in parallel operation. Accordingly, a portion of the fluid incident on node N2 is directed to an inlet of the third drive motor 310C.

Another portion of the fluid incident on node N2 is directed to an inlet of the second motor 310B via pathway P2B. In particular, pathway P2B is in communication with first parallel valve 325A, which is in open in parallel operation. First parallel valve 325A thus directs the fluid received from pathway P2B to node N13 via pathway P13A. Node N13 is in further communication with pathway P13B and pathway P12A.

Pathway P12A is operatively associated with the internal flushing system 350 through node N11 by way of pathway P11B. Accordingly, the pathway P12A provides a flow to node N13 to supplement the fluid received from pathway P13A and directs the combined flow to an inlet of the second motor 310B. As a result, in parallel operation fluid incident on N1 by way of pathway 335 is directed to inlets of the first, second, and third motors 310A, 310B, 310C.

A portion of the fluid incident on node N6 by way of pathway 335' is directed to opposing inlets of the first, second, and third motors 310A, 310B, 310C. In particular, node N1 directs a portion of the fluid incident thereon directly to an opposing inlet of the first motor 310A. Another portion of the flow is directed through pathway P6B to node N7. Node N7 is in further communication with pathways P7A, P7B, and P7C. Pathway P7C is in communication with the internal flushing system 350 via node N3. Pathways P7A and P7B are in communication with second parallel valve 325B' and first parallel valve 325A' respectively, which are each open. As a result, fluid directed to first parallel valve 325A' is directed to node N14 via pathway P14B. Node N14 is in further communication with pathways P14A and 360. Pathway 360 is in communication with the first coupling cartridge 320A, which is closed. Accordingly, a flow directed to first parallel valve 325A' is directed to an opposing inlet of the second motor 310B.

A flow directed to the second parallel valve 325B' is directed to node N16 via pathway P16B. Node N16 is in communication with node N15 via pathway P15A. Node 15 is in further communication with the internal flushing system 350 by way of pathway P11A and node N11. The fluid node N16 from second parallel valve 325B' and the internal flushing system 350 is directed to an opposing outlet of the third drive motor 310C.

Accordingly, flow from pathway 335 is directed to inlets of the first, second, and third motors 310A, 310B, 310C while flow from pathway 335' is directed to opposing inlets of the first, second, and third motors 310A, 310B, 310C. Further, the internal flushing system 350 is configured to provide a supplemental flow to help ensure proper flow at all operating pressures. Such a configuration can help ensure proper operation of the motors 310A, 310B, 310C while also cooling and lubricating the motors 310A, 310B, 310C.

Figure 4:
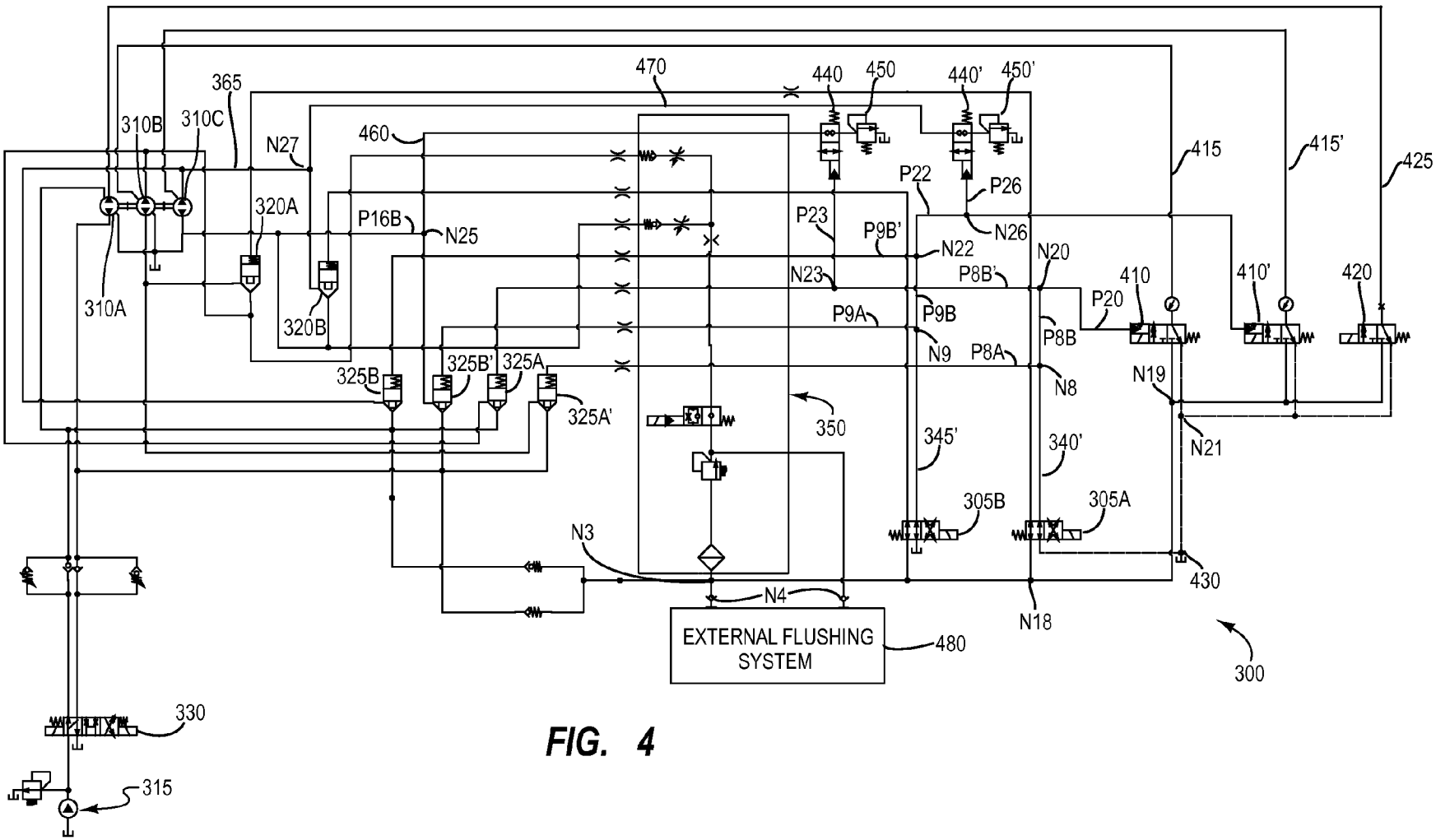
FIG. 4 is a schematic diagram of a control system according to one example.

In addition, as illustrated in FIG. 4, the hydraulic control system 300 can have additional, optional valve assemblies. For example, optional two-speed valve assembly 400 operatively associated therewith. The optional two-speed valve assembly 400 can receive a flow via node N18 and node N19, which receive a portion directed to the flow directed to the first and second switching valves 315A, 315B as described above. The two-speed valve assembly 400 can include valves 410 and/or 410' operatively associated with the second and third motor 310B, 310C. Similarly, valve 420 can be operatively associated with the first motor 310A.

Each or all of the valves 410, 410', 420 are configured to vary the displacement of the associated motors. In particular, the two-speed valves 410, 410', 420 can vary the displacement of the associated motors between a full displacement and half-displacement. Varying the displacement of the motors can change the motors between high torque and high speed operation. In high speed operation, it may be desirable to reduce the flow of volume provided by the internal flushing system 350 as the volume which has to circulate by freewheeling of the associated motor is lower and thus less flushing oil flow is needed. Reducing the volume of the flushing oil can help ensure a higher possible RPM of the associated motor.

In at least one example, the two speed valve 420 provides an oil flow to a two-speed port on the first motor 310A via pathway 425. The other motors 310B, 310C can also include a two-speed port in communication with pathways 415, 415' respectively. A two-speed port can switch the operation of the motors 310A, 310B, 310C can between full displacement and half displacement when a selected pressure difference is established between inlet port and outlet ports on the motor.

In at least one example, the two-speed valves 410, 410' can be automatically switched between full displacement and half-displacement. As illustrated in FIG. 4 the two-speed-valves 410, 410' receive an input from parallel valves 305A, 305B respectively. In particular, first parallel valve 305A directs an output through pathways P8A and P8B' to close parallel cartridges. In particular, pathway 340' is in communication with node N8. Node N8 is in further communication pathways P8A and P8B. Node N20 is positioned between pathway P8B and pathway P8B'. Pathways P8A and P8B' are in communication with first parallel valves 325A', 325A respectively. Node N20 is in further communication with two-speed valve 410 via pathway P20. Accordingly, a portion of the fluid the first switching valve 305A directs through pathway 340' is directed to two-speed valve 410 to thereby open the two-speed valve 410.

The two-speed valves 410 and 410' are pilot oil operated type which can be overridden, such as electrically overridden. Two-speed valve 420 can be electrically operated and be actuated by the pilot oil from node N20 when either of the switching valves 305A, 305B are actuated to series mode. The pilot oil for changing the valve position of two-speed valve 410' can be received from node N22. In such a configuration, when motor 310B and/or 310C are changed from parallel to series operation as described above, the two-speed function will switch the motors 310A, 310B, 310C to the lower displacement automatically by transmitting fluid over pathways 415, 415', 425 respectively.

All the two-speed valve(s) 410,410', 420 can also include a connection for the tank line via node N21. In particular, node incident on node N21 flows from N21 back to a reservoir or tank inlet 430. Accordingly, in series operation a portion of the fluid received from N19 flow via valve 410 and/or 410' and/or 420 to the two-speed ports on the motors and change their position from half displacement to small displacement. As previously discussed, in series operation fluid from the pump 315 is split between opposing inlets of the first motor 310A and node N3. Fluid incident on node N3 is further split between the internal flushing system 350 and the first and second switching valves 305A, 305B.

Accordingly, two-speed valve 410 automatically reduces the volume of fluid directed trough at least motor 310B. Because of that the oil volume which has to circulate by freewheeling of the motor is lower and less flushing oil flow is needed and which ensures a higher possible RPM.

When the two-speed valve is open 410, fluid directed to the two-speed valve 410 is directed to node N21, which is in communication with the other two-speed valve(s) 410', 420 and a reservoir or tank inlet 430. Accordingly, in series operation a portion of the fluid received and transmitted by the first switching valve 305A opens the two-speed valve 410 and is then diverted to the fluid reservoir via the tank inlet 430. As previously discussed, in series operation fluid from the pump 315 is split between opposing inlets of the first motor 310A and node N3. Fluid incident on node N3 is further split between the internal flushing system 350 and the first and second switching valves 305A, 305B.

As previously discussed, the internal flushing system 350 provides fluid to opposing inlets of the second motor 310B when the second motor 310B is driven in series. By diverting a portion of the fluid incident on node N3 to the tank inlet 430, the two-speed valve 410 reduces the volume of fluid the internal flushing system 350 directs to the motors 310B and/or 310C in series operation. Accordingly, two-speed valve 410 automatically reduces the volume of fluid directed to at least motor 310B. Because of that the oil volume which has to circulate by freewheeling of the motor is lower and less flushing oil flow is needed and which ensures a higher possible RPM.

Similarly, two-speed valve 410' can reduce the flow of fluid the internal flushing system 350 directs to the second and/or third motors 310B, 310C. In particular, second parallel valve 305B directs an output through pathways P9A and P9B' to close second parallel cartridges 325B' 325B respectively. In particular, pathway 345' is in communication with node N9. Node N9 is in further communication pathways P9A and P9B. Node N22 is positioned between pathway P9B and pathway P9B'. Pathways P9A and P9B' are in communication with second parallel valves 325B', 325B respectively. Node N21 is in further communication with two-speed valve 410' via pathway P22.

Accordingly, a portion of the fluid the second switching valve 305A directs through pathway 345' is directed to two-speed valve 410' to thereby open the two-speed valve 410'. Two-speed valve 410' is in communication with node N21, which is in communication with tank inlet 430. Accordingly, two-speed valve 410' automatically reduces the volume of fluid directed to at least motor 310C. Because of that the oil volume which has to circulate by freewheeling of the motor is lower and less flushing oil flow is needed and which ensures a higher possible RPM.

FIG. 4 also illustrates additional valve assemblies 440, 440', 450, 450' configured to protect the motors 310A, 310B, 310C against pressure peaks, including those that may occur in series operation. In particular, pathway 9B' can be in communication with valve 440 via node N23 and pathway P23. Such a configuration causes a portion of the flow the first switching valve 305A outputs through pathway 340' is directed to valve 440. This portion of the flow can act to open valve 440. Valve 440 is in communication with valve 450 as well as pathway 460. Pathway 460 is in communication with pathway P16B via node N25.

Pathway P16B is in communication with third drive motor 310C by way of node N16 and pathway P16A (FIGS. 3A-3B). Accordingly, valve 440 is in communication with third motor 310C. While valve 440 is open, a pathway is established between valve 450 and the third motor 310C. Valve 450 can be or include a pressure limiting valve. Such a configuration can allow valve 450 to maintain the pressure of the third motor 310C below a desired level and thereby protect the third motor 310C from pressure spikes or other pressure increases. In the illustrated example, valves 440, 450 are actuated by the first switching valve 305A. In other examples, the valves 440, 450 can be actuated by the second switching valve 305B and/or be operatively associated with the second motor 310B.

Referring again to the example shown in FIG. 4, valves 440', 450' can be actuated by the second switching valve 305B to help protect the second motor 310B from pressure spikes. In particular, the second switching valve 305B is in communication with valve 440' by way of pathways 345', P9B and P26 via node N26. The second switching valve 305B can direct a flow via this pathway to open the valve 440'.

Valve 440' is in communication with the second motor 310B via pathway 470, node N27 and pathway 365. When the valve 440' is open, valve 450' is also in communication with the second motor 310B by way of valve 440'. Valve 450' can be or include a pressure limiting valve. Such a configuration can allow valve 450' to maintain the pressure of the second motor 310B below a desired level and thereby protect the third motor 310B from pressure peaks or other pressure increases. In the illustrated example, valves 440', 450' are actuated by the second switching valve 305B. In other examples, the valves 440', 450' can be actuated by the first switching valve 305B and/or be operatively associated with the third motor 310C. Accordingly, optional valves can be provided to protect the second and third motors 310B, 310C against pressure peaks.

As previously introduced, node N4 can be configured to allow the hydraulic control system 300 to have an external flushing system 480 coupled thereto. The external flushing system 350 can be configured to provide additional flow as desired to provide a desired displacement and/or additional cooling.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method of controlling a plurality of hydraulic motors, comprising: operating a second motor in series with a first motor by:

providing fluid from an outlet of a pump to a first motor to drive the first motor, directing the fluid from an outlet of the first motor to the second motor to drive the second motor; and selectively switching the second motor from operating in series with the first motor to operating in parallel with the first motor by:

blocking the fluid from the outlet of the first motor from driving the second motor, directing a first portion of fluid from the outlet of the pump to the first motor to drive the first motor, and directing a second portion of fluid from the outlet of the pump to the second motor to drive the second motor;

wherein:

the first motor is operatively associated with a drill head such that driving the first motor rotates a drive shaft of the drill head, and the second motor is operatively associated with the drill head such that driving the second motor rotates the drive shaft of the drill head.

2. The method as recited in claim 1, further comprising driving a third motor in series with the second motor by directing the fluid from an outlet of the second motor to the third motor to drive the third motor.

3. The method as recited in claim 2, wherein the third motor is operatively associated with the drill head such that driving the third motor rotates the drive shaft of the drill head.

4. The method as recited in claim 2, further comprising selectively switching the third motor from operating in series with the second motor to operating in parallel with the second motor by:

blocking the fluid from the outlet of the second motor from driving the second motor, directing the second portion of fluid from the outlet of the pump to the second motor to drive the second motor, and directing a third portion of fluid from the outlet of the pump to the third motor to drive the third motor.

5. The method as recited in claim 1, further comprising directing a balanced flow of fluid to opposing inlets of the second motor when operating the second motor in series with the first motor, thereby allowing the second motor to free wheel.

6. The method as recited in claim 5, further comprising providing at least a portion of the balanced flow of fluid from an internal flushing system.

7. The method as recited in claim 1, further comprising selectively switching the second motor between high torque and high speed operation.

8. The method as recited in claim 7, wherein selectively switching the second motor between high torque and high speed operation comprises varying a first displacement of the second motor between full displacement and half-displacement.

9. The method as recited in claim 1, wherein selectively switching the second motor between high torque and high speed operation comprises reducing a flow of fluid to the second motor.

10. A method of controlling a plurality of hydraulic motors, comprising:

operating a second motor in parallel with a first motor by:

directing a first portion of fluid from an outlet of a pump to the first motor to drive the first motor, and directing a second portion of fluid from the outlet of the pump to the second motor to drive the second motor; and selectively switching the second motor from operating in parallel with the first motor to operating in series with the first motor by:

blocking the second portion of fluid from driving the second motor, directing fluid from an outlet of the first motor to the second motor to drive the second motor;

wherein:

the first motor is operatively associated with a drill head such that driving the first motor causes a drive shaft of the drill head to rotate, and the second motor is operatively associated with the drill head such that driving the second motor causes the drive shaft of the drill head to rotate.

11. The method as recited in claim 10, further comprising driving a third motor in parallel with the first and second motors by directing a third portion of fluid from the outlet of the pump to the third motor to drive the third motor.

12. The method as recited in claim 11, further comprising selectively switching the third motor from operating in parallel with the second motor to operating in series with the second motor by:

blocking the third portion of fluid from the outlet of the pump from driving the third motor, directing fluid from an outlet of the third motor to drive the third motor.

13. A method of drilling, comprising:

driving a first motor with a pump;

selectively driving a second motor in series operation by blocking at least a portion of the output of the pump from passing through first parallel valves while directing at least a portion of the output of the pump through a first coupling valve to opposing inlets of the second motor such that a portion of the output of the first motor drives the second motor;

selectively driving the second motor in parallel operation by directing at least a portion of the output of the pump through the parallel valves while blocking at least a portion of the output of the pump through the first coupling valve; and selectively driving a third motor in series operation by blocking at least a portion of the output of the pump from passing through second parallel valves while directing at least a portion of the output the pump through a second coupling valve to opposing inlets of the third motor and selectively driving at least one of the first motor, the second motor.

14. The method of claim 13, wherein selectively directing the output of the pump through the first coupling valve and selectively directing the output of the pump through the second coupling valve are independently selectable.

15. The method of claim 14, wherein driving the first motor has a first displacement and the second motor has a second displacement, the second displacement being different than the first displacement.

16. The method of claim 13, further including providing sufficient flow with an internal flushing system having a pressure-compensated control valve.

17. The method of claim 13, further including selectively replacing at least one of the first motor and the second motor.

* * * * *